United States Patent [19]

Schonmeier

[11] 4,266,736

[45] May 12, 1981

[54] METHOD AND APPARATUS FOR THE MODULATED RAISING OF THE CARRIAGES OF A WIND-UP ROLL IN THE CENTERLESS WINDING OF WEBS

[75] Inventor: Herbert Schonmeier, Dusseldorf, Fed. Rep. of Germany

[73] Assignee: Jagenberg Werke AG, Dusseldorf, Fed. Rep. of Germany

[21] Appl. No.: 100,777

[22] Filed: Dec. 6, 1979

[30] Foreign Application Priority Data

Dec. 12, 1978 [DE] Fed. Rep. of Germany ..... 2853548

[51] Int. Cl.[3] ..... B65H 17/08

[52] U.S. Cl. ..... 242/66

[58] Field of Search ..... 242/66, 65, 67.1 R, 242/67.2, 67.3, 67.4, 67.5, 75, 75.2, 55

[56] References Cited

U.S. PATENT DOCUMENTS

| | | | |
|---|---|---|---|
| 3,104,845 | 9/1963 | Patterson | 242/66 |
| 3,373,952 | 3/1968 | Klaczkiewicz | 242/66 |
| 3,599,889 | 8/1971 | Pfeiffer | 242/66 |

FOREIGN PATENT DOCUMENTS

| | | | |
|---|---|---|---|
| 28437 | 7/1972 | Japan | 242/66 |

*Primary Examiner*—Edward J. McCarthy

*Attorney, Agent, or Firm*—Sprung, Felfe, Horn, Lynch & Kramer

[57] ABSTRACT

A method and apparatus for the centerless winding of webs has a pressure cylinder which lies on a wind-up roll, both of which are mounted on vertical movement. The vertical movement of the carriage mounting the wind-up roll is modulated by coupling the vertical movement of the pressure cylinder therewith such that the carriages follow the movement of the pressure cylinder to a degree corresponding to the momentary degree to which the wind-up roll has been wound.

5 Claims, 3 Drawing Figures

METHOD AND APPARATUS FOR THE MODULATED RAISING OF THE CARRIAGES OF A WIND-UP ROLL IN THE CENTERLESS WINDING OF WEBS

BACKGROUND OF THE INVENTION

The invention relates to a method and an apparatus for the modulated raising of the carriages by which a wind-up roll held on stub shafts inserted into its core tube is carried for vertical displacement in the centerless winding of webs, while a pressure cylinder lies axially parallelly on the wind-up roll.

In the centerless winding of webs of paper, textiles or plastics, the roll being wound lies on two supporting cylinders of which at least one is driven in rotation. After the leading end of the web has been attached to the wind-up roll core tube, the supporting cylinder or cylinders are set in rotation thereby causing the wind-up roll lying axially parallel on their circumference also to rotate. To control the winding tightness, a pressure cylinder lies on the outer circumference of the wind-up roll axially parallel thereto, for the purpose of the uniform winding of the wind-up roll so as to prevent the formation of wrinkles.

To prevent the wind-up roll from creeping in the axial direction and to achieve an accurately positioned winding of the wind-up roll, lateral guides are provided in which carriages can travel or be displaced vertically and which are joined to the wind-up roll by means of stub shafts inserted into the core tube.

As the winding progresses, the axis of the wind-up roll rises, and especially in the case of rolls which are much narrower than the nominal working width of the winding machine the carriages can jam because the lever arm (the distance between the carriage and the end of the wind-up roll) is great and the stub shaft become cocked causing interference between the carriage and its track.

To counteract these difficulties, it is known to make the carriages follow the movement of the wind-up roll through the use of an independent drive in the form of air cylinders or hydraulic cylinders, for example. This, however, is a very expensive and complex method. Furthermore, the carriages can still jam, because the known drives operate according to their own peculiar laws of motion, not according to the law of motion of the growing wind-up roll.

SUMMARY OF THE INVENTION

It is the purpose of the present invention to create a simple and inexpensive method and apparatus in which the carriages will not jam in spite of the complex law of motion of the growing wind-up roll.

To achieve this purpose, a method and apparatus are proposed in accordance with the invention which permits a modulated raising of the carriages since the movement of the carriages is derived from that of the pressure cylinder such that, as the pressure cylinder moves upwardly, the carriages are taken up by an amount corresponding to the degree to which the wind-up roll has been wound.

In this manner any cocking or jamming of the carriages in their guides is prevented.

To the pressure cylinder lying on the wind-up roll there is usually fastened, as shown also in U.S. Pat. No. 3,373,952, a cable or chain which is carried over pulleys and held under tension by a power source, namely a counterweight, or a pneumatic or hydraulic system. As the winding of the wind-up roll increases, the pressure cylinder lying on it is raised up and the cable or chain connected to it moves under the influence of the power source which keeps it under tension.

There is not a linear relationship between the upward movement of the pressure cylinder and the upward movement of the wind-up roll, because at the beginning of the winding, when the diameter of the roll is still small, the axis of the wind-up roll rises more rapidly than it does toward the end of the winding action, when the roll diameter is large. Also, in the course of winding the axis of the pressure cylinder is raised up by approximately twice the amount of the rise of the axis of the wind-up roll. Therefore, in an apparatus for the practice of the method of the invention, it is proposed that the pulley over which the cable attached to the pressure cylinder is passed be joined to a cam over which the cables are passed whose one end is attached to the carriage on which stub shafts inserted into the core tube of the wind-up roll are mounted, and whose other end is fastened to a point on the cam, at least the cable fastened to the pressure cylinder being held in the continuously tensed state by a power source.

It is preferred that the cables be kept in the tensed state by separate sources of power. Furthermore, in an advantageous manner, the pulley is to be joined to the cam by a clutch. This makes it possible to disengage the cam from the pulley so that the carriages and the pressure cylinder can be operated separately, especially when a fresh wind-up roll is being inserted or in the event of any trouble.

BRIEF DESCRIPTION OF THE DRAWINGS

The invention will now be further explained with the aid of the embodiment represented in the drawing, wherein.

DETAILED DESCRIPTION OF THE INVENTION

Figure 1:
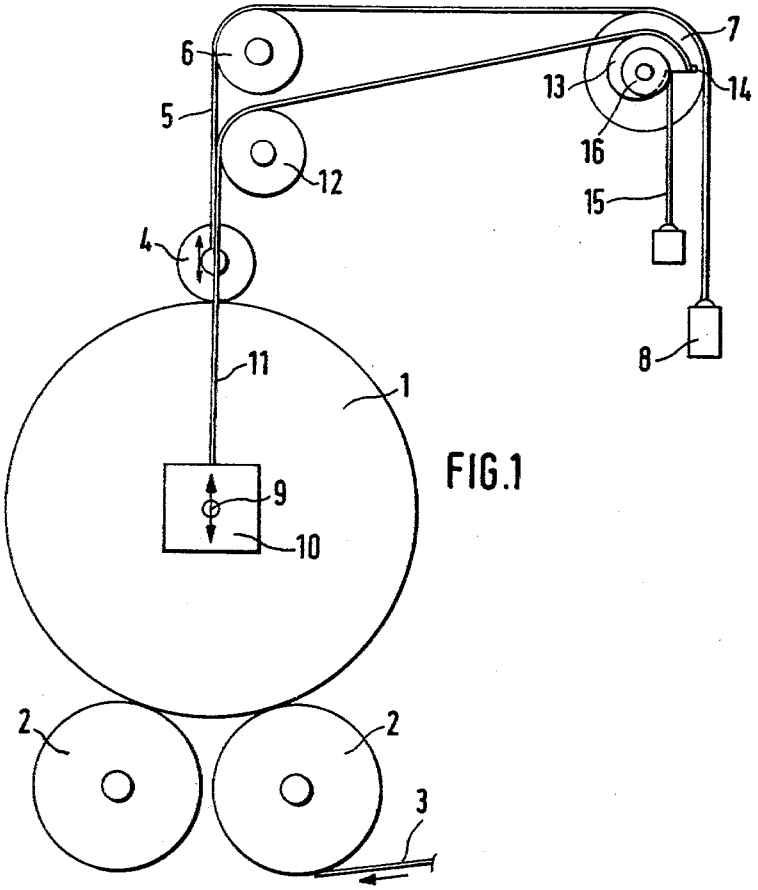
FIG. 1 is a diagrammatic, side-elevational view of the winding machine.
Figure 2:
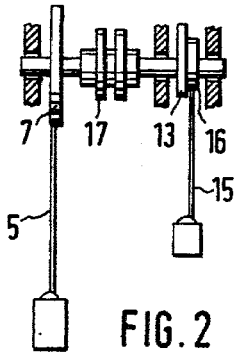
FIG. 2 is a front view of the clutch coupling of the pulley with the cam.
Figure 3:
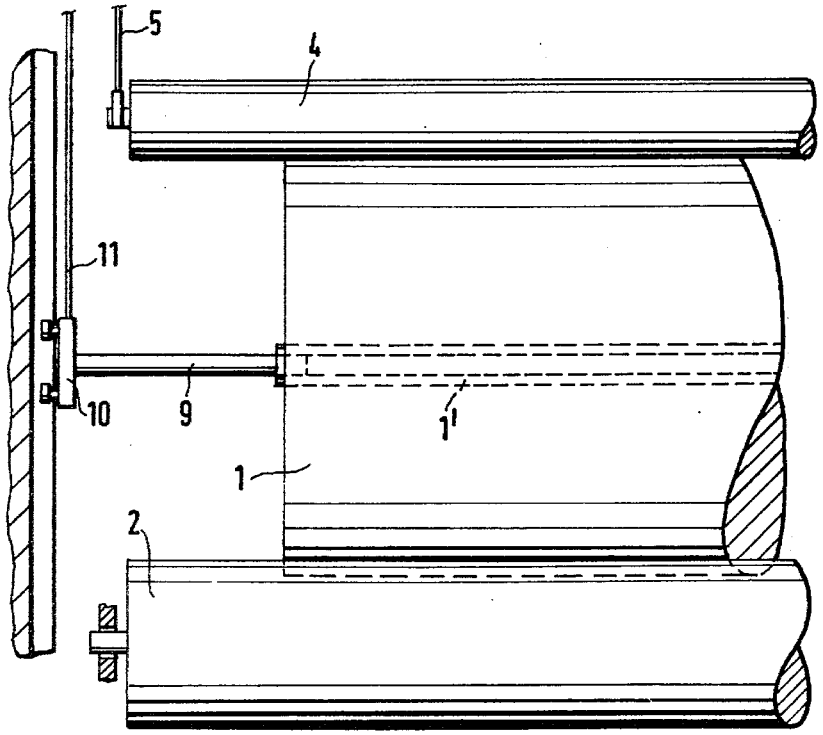
FIG. 3 is a front view of the carriage mounting of the wind-up roll.

Referring now to FIGS. 1–3, the wind-up roll 1 lies axially parallel on two support cylinders 2, at least one of which must be driven for rotation. Upon the rotation of the support cylinders 2, the wind-up roll 1 is also set in rotation to wind up a web of goods 3.

To control the winding tightness, a pressure cylinder 4 lies on the wind-up roll 1 and is axially parrallel thereto. To enable the pressure of the pressure cylinder 4 on the wind-up roll 1 to be controlled, cables 5 or chains are fastened to the shafts of the pressure cylinder 4, and they are carried over pulleys 6 and 7 and their other ends are fastened to the diagrammatically indicated power or force sources 8, which hold the cable 5 under constant tension.

Each stub shaft 9, which extends into the tubular core 1' of the wind-up roll 1, is fastened to a carriage 10 which is disposed for vertical displacement in guides. To each carriage 10 there is linked a cable 11 or a chain which is carried around a pulley 12 and a cam 13, and is fastened to the latter at point 14. By means of a weight-loaded cable 15, which is carried around a drum 16 connected to the cam 13, the cable 11 is kept constantly under tension.

The pulley 7 is best connected to the cam 13 by means of a clutch 17. The clutch 17, when disengaged, permits a separate upward or downward movement of the pressure cylinder and of the carriages 10, but when it is engaged it produces a tight coupling between the pulley 7 and the cam 13, so that the cables 11, upon the movement of the cables 5, will follow the movement of the latter to the degree provided by the configuration of the cam 13. This degree is a function of the upward movement of the axis of the wind-up roll 10 in relationship to the upward movement of the axis of the pressure cylinder 4.

It will be appreciated that the instant specification and examples are set forth by way of illustration and not limitation, and that various modifications and changes may be made without departing from the spirit and scope of the present invention.

What is claimed is:

1. In a method for the centerless winding of webs of the type wherein a pressure cylinder lies on a wind-up roll having stub shafts inserted in its core and mounted on movable carriages and the vertical displacement of the carriage is modulated, the improvement wherein the modulation of the movement of the carriages comprises coupling the vertical movement of the carriages with the upward movement of the pressure cylinder such that the carriages follow that movement to a degree corresponding to the momentary degree to which the wind-up roll has been wound.

2. An apparatus for the centerless winding of webs comprising: a rotatably driven wind-up roll; means mounting the wind-up roll for vertical displacement of the axis thereof; a pressure cylinder disposed axially parallel to the wind-up roll; and means for modulating the vertical displacement of the wind-up roll comprising means mounting the pressure cylinder for vertical displacement of the axis thereof and means coupling the vertical movement of the wind-up roll to the vertical movement of the pressure cylinder such that the movement of the wind-up roll follows that movement to a degree corresponding to the momentary degree to which the wind-up roll has been wound.

3. Apparatus according to claim 2, wherein the means mounting the pressure cylinder comprises a pulley and first cables connected at one end to the pressure cylinder and over the pulley, the means mounting the wind-up roll comprises a core tube of the roll, stub shafts inserted therein, carriages connected to the stub-shafts, second cables connected to the carriages and a cam over which the second cables are connected, wherein the coupling means comprises means connecting the pulley and cam and means maintaining at least the first cables in the continuously tensed state.

4. Apparatus according to claim 3, wherein the coupling means comprises separate power sources for keeping the first and second cables constantly in the tensed state.

5. Apparatus according to claim 3 or claim 4, wherein the coupling means comprises a clutch connecting the cam to the pulley.

* * * * *